US012448855B2

(12) United States Patent
Van Haecke et al.

(10) Patent No.: US 12,448,855 B2
(45) Date of Patent: Oct. 21, 2025

(54) OILFIELD DATA PROCESSING USING DISTRIBUTED DEVICES

(71) Applicant: SCHLUMBERGER TECHNOLOGY CORPORATION, Sugar Land, TX (US)

(72) Inventors: Bernard Van Haecke, Mountain View, CA (US); Swaroop Kalasapur, San Jose, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 446 days.

(21) Appl. No.: 17/760,015

(22) PCT Filed: Feb. 7, 2020

(86) PCT No.: PCT/US2020/017124
§ 371 (c)(1),
(2) Date: Aug. 3, 2022

(87) PCT Pub. No.: WO2021/158230
PCT Pub. Date: Aug. 12, 2021

(65) Prior Publication Data

US 2023/0340845 A1 Oct. 26, 2023

(51) Int. Cl.
*E21B 21/08* (2006.01)
*E21B 47/12* (2012.01)
*E21B 47/14* (2006.01)

(52) U.S. Cl.
CPC ..... *E21B 21/08* (2013.01); *E21B 47/12* (2013.01); *E21B 47/14* (2013.01)

(58) Field of Classification Search
None
See application file for complete search history.

(56) References Cited

U.S. PATENT DOCUMENTS 5,597,042 A * 1/1997 Tubel ..... E21B 43/12 166/250.15
6,276,190 B1 * 8/2001 Zamfes ..... G01N 33/2823 73/19.09

(Continued)

FOREIGN PATENT DOCUMENTS

AU 2016250439 A1 5/2017
CN 103166936 A 6/2013

(Continued)

OTHER PUBLICATIONS

Search Report and Written Opinion of International Patent Application No. PCT/US2020/17124 on May 7, 2020; 9 pages.

(Continued)

*Primary Examiner* — Charles E Anya
(74) *Attorney, Agent, or Firm* — Jeffrey D. Frantz

(57) ABSTRACT

Computing systems, computer-readable media, and methods for processing data are described herein. A method can include detecting a processing capability of respective devices of a plurality of devices and storing indicators each of which represents the processing capability of the respective devices of the plurality of devices. Additionally, the method can include detecting, from a first device of the plurality of devices, a request to execute a resource extraction instruction using the stored indicators and selecting, based on the stored indicators, a second device to execute the resource extraction instruction. The method can include forwarding the request to a second device, retrieving a result for the request from the second device, and returning the result to the first device.

20 Claims, 7 Drawing Sheets

(56) References Cited

U.S. PATENT DOCUMENTS

| | | | | |
|---|---|---|---|---|
| 6,571,886 | B1 * | 6/2003 | Sullivan | E21B 47/013 73/53.05 |
| 8,676,981 | B2 | 3/2014 | Hackett et al. | |
| 2006/0285436 | A1 * | 12/2006 | Mayorga Lopez | G01V 1/40 367/27 |
| 2009/0062936 | A1 * | 3/2009 | Nguyen | G06N 3/043 700/50 |
| 2009/0166031 | A1 * | 7/2009 | Hernandez | E21B 47/12 166/250.01 |
| 2011/0305105 | A1 * | 12/2011 | Dean | G01V 1/003 367/14 |
| 2014/0273831 | A1 * | 9/2014 | Walton | E21B 43/116 455/41.1 |
| 2015/0122490 | A1 * | 5/2015 | Greening | E21B 21/019 166/250.01 |
| 2016/0065622 | A1 | 3/2016 | Flanders et al. | |
| 2018/0359130 | A1 | 12/2018 | Zheng et al. | |
| 2019/0041830 | A1 | 2/2019 | Yarvis et al. | |
| 2020/0109612 | A1 * | 4/2020 | Granville | E21B 43/12 |
| 2020/0392831 | A1 * | 12/2020 | Wu | E21B 41/00 |
| 2021/0108499 | A1 * | 4/2021 | Aarsland | E21B 44/00 |

FOREIGN PATENT DOCUMENTS

| | | | | |
|---|---|---|---|---|
| CN | 109477376 | A | 3/2019 | |
| WO | WO-9624749 | A1 * | 8/1996 | E21B 34/066 |
| WO | 2009022286 | A2 | 2/2009 | |
| WO | 2018222594 | A1 | 12/2018 | |

OTHER PUBLICATIONS

Extended Search Report issued in European Patent Application No. 20917306.1 dated Oct. 4, 2023, 7 pages.

International Preliminary Report on Patentability of International Patent Application No. PCT/US2020/17124 on Aug. 18, 2022, 8 pages.

Exam Report issued in Canadian Patent Application No. 3170164 dated Aug. 8, 2024, 4 pages.

* cited by examiner

500

OILFIELD DATA PROCESSING USING DISTRIBUTED DEVICES

CROSS-REFERENCE TO RELATED APPLICATION

This application is a national stage entry under 35 U.S.C. 371 of International Application No. PCT/US2020/017124, filed Feb. 7, 2020.

BACKGROUND

Various aspects of resource extraction from geological formations can include detecting data and processing the data with a number of different hardware components and software applications. The data can be associated with the operation of a drilling rig, seismic testing, and the like. For example, interpretation of geological structures within seismic datasets can enable the exploration, development, and production of resources such as petroleum, among others. The data corresponding to seismic testing or the operation of a drilling rig can be collected by various sensors coupled to multiple computing devices. In some examples, aggregating and analyzing the data collected by the sensors can include transmitting the data between multiple interconnected computing devices or transmitting the data to a server that manages the computing devices and sensors of a system.

In some examples, each system can include various computing devices coupled to different sensors, actuators, storage devices, communication interfaces, and the like. Executing an application for resource extraction can include determining which computing device of a system has the software or the hardware capabilities to perform the instructions of the application.

SUMMARY

Embodiments of the present disclosure can provide a system for processing data. For example, the system can include storage devices and a processor to execute instructions stored in the storage devices. In some embodiments, the instructions can cause the processor to perform operations including detecting a processing capability of respective devices of a plurality of devices and storing indicators each of which represents the processing capability of the respective devices of the plurality of devices. The operations can also include detecting, from a first device of the plurality of devices, a request to execute a resource extraction instruction using the stored indicators and selecting, based on the stored indicators, a second device from the plurality of devices to execute the resource extraction instruction. Furthermore, the operations can include forwarding the request to the second device of the plurality of devices, and retrieving a result for the request from the second device. In some examples, the result is returned to the first device.

In some embodiments, the processing capability can include a graphics processing unit, a flow rate sensor, a pressure sensor, an encrypted data repository, a network interface card, an actuator, a thermal camera, a depth camera, or a combination thereof. In some examples, the processing capability can include an artificial intelligence application that identifies at least one first object from an image, identifies at least one second object from a video, detects at least one anomaly in a data stream, or a combination thereof.

In some embodiments, the operations can include polling the plurality of devices to determine available devices with the processing capability identified in the request and storing identifiers for the available devices. In some examples, one of the available devices is the second device that is selected to receive the request.

In some embodiments, the processing capability can include at least one of a sensor coupled to a drilling rig or a software application that analyzes sensor data from the sensor.

In some examples, processing the request can include detecting at least one of a source identifier, a destination identifier, or payload data that represents the processing capability of the request. In some embodiments, the operations can include generating a queue for the devices associated with the processing capability identified in the request.

In some examples, the operations can include generating a priority indicator for the request. For example, the priority indicator can be based on memory usage within the second device, a queue of instructions to execute with the second device, or a combination thereof.

In some embodiments, the operations can include determining, using the priority indicator, that the request is to be executed with the second device prior to a second request previously received by the second device.

In some examples, the resource extraction instruction includes detecting sensor data from a sensor coupled to a drilling rig. In some embodiments, the second device identifies an event from the sensor data and the response to the request includes a command that uses the event to determine a state of an actuator. In some embodiments, the resource extraction instruction can include detecting a flow rate of a mud material through a flow pipe of a drilling rig.

In some embodiments, a system for processing data includes storage devices and a processor to execute instructions stored in the storage devices. The instructions can cause the processor to perform the operations including detecting a request including a resource extraction instruction to execute and detecting a processing capability of the resource extraction instruction. The operations can also include transmitting the request along with data representing the processing capability to a service device for execution and receiving a response from the service device, the response including data generated by executing the resource extraction instruction. Furthermore, the operations can include executing a transaction based on the response.

In some examples, the processing capability can include a graphics processing unit, a flow rate sensor, a pressure sensor, an encrypted data repository, a network interface card, an actuator, a thermal camera, a depth camera, or a combination thereof. In some examples, the processing capability can include an artificial intelligence application that identifies first objects from an image, identifies second objects from a video, detects anomalies from a data stream, or a combination thereof.

In some embodiments, the transaction can include transmitting an alert to an external device based on the anomalies. In some examples, the processing capability further includes dynamic information that represents an amount of memory or an amount of cache to execute the resource extraction instruction. In some embodiments, the transaction can include transmitting an alert representing a flow rate of a component of a drilling rig to an external device.

In some embodiments, a method for processing data can include detecting a processing capability of respective devices of a plurality of devices and storing indicators each of which represents the processing capability of the respective devices of the plurality of devices. The method can also include detecting, from a first device of the plurality of devices, a request to execute a resource extraction instruction using the stored indicators and selecting, based on the stored indicators, a second device from the plurality of devices to execute the resource extraction instruction. Furthermore, the method can include forwarding the request to the second device of the plurality of devices and retrieving a result for the request from the second device, wherein the result is returned to the first device.

Thus, the computing systems and methods disclosed herein are more effective methods for processing collected data that may, for example, correspond to a surface and a subsurface region. These computing systems and methods increase data processing effectiveness, efficiency, and accuracy. Such methods and computing systems may complement or replace conventional methods for processing collected data. This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DESCRIPTION OF EMBODIMENTS

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

Figure 1:
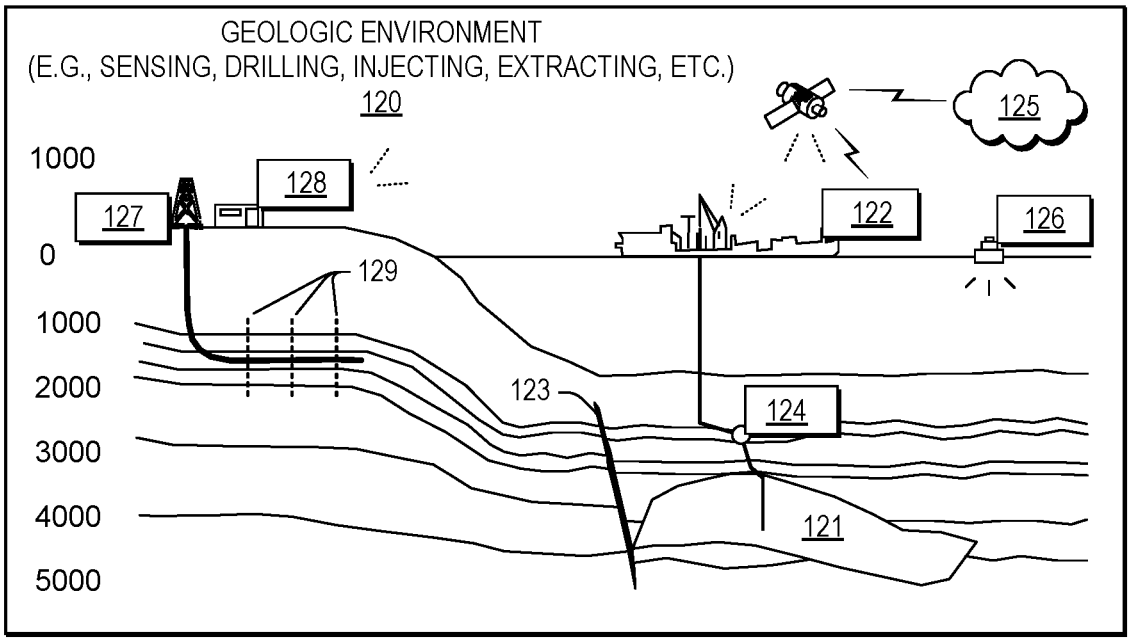
FIG. 1 illustrates examples of equipment in a geologic environment, according to an embodiment.
Figure 1:
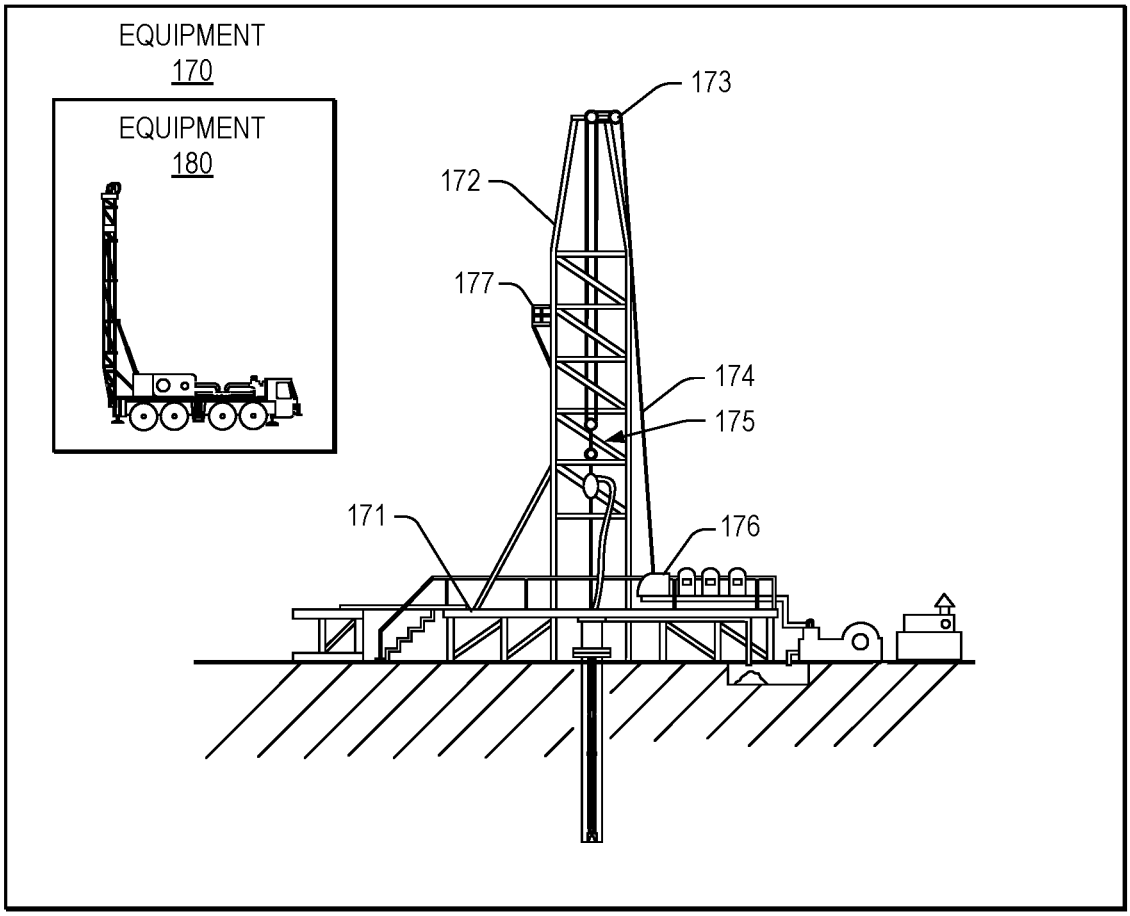

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and/or to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, geolocation, etc. For example, FIG. 1 shows a satellite in communication with the network 125 that may be configured for communications, noting that the satellite may additionally or alternatively include circuitry for imagery (e.g., spatial, spectral, temporal, radiometric, etc.). As an example, rotation or vibration sensors may generate more data per second that the communication method may be able to support, in this case data preprocessing and machine learning within the sensor generates data only when recognized or unrecognized situations occur.

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system. As shown in FIG. 1, the equipment 180 can be mobile as carried by a vehicle; noting that the equipment 170 can be assembled, disassembled, transported and re-assembled, etc.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrick person may be a rig crew member that works on a platform attached to a derrick or a mast. A derrick can include a landing on which a derrick person may stand. As an example, such a landing may be about 10 meters or more above a rig floor. In an operation referred to as trip out of the hole (TOH), a derrick person may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrick person controls the machinery rather than physically handling the pipe.

As an example, a trip may refer to the act of pulling equipment from a bore and/or placing equipment in a bore. As an example, equipment may include a drillstring that can be pulled out of the hole and/or place or replaced in the hole. As an example, a pipe trip may be performed where a drill bit has dulled or has otherwise ceased to drill efficiently and is to be replaced.

Figure 2:
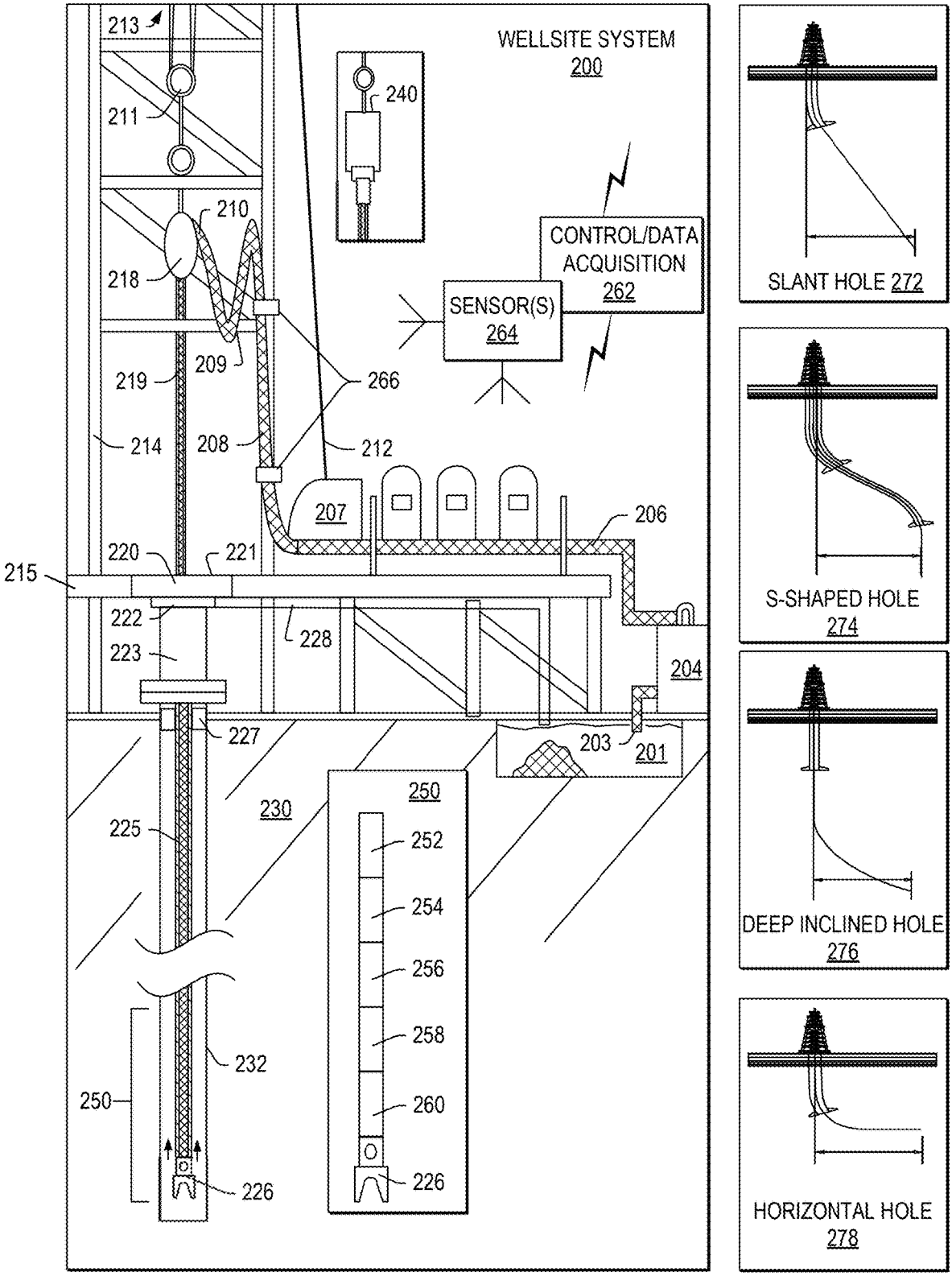
FIG. 2 illustrates an example of a system and examples of types of holes, according to an embodiment.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventers (BOPS) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the platform 215 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drill string 225 may be pulled from a wellbore and optionally replaced, for example, with a new or sharpened drill bit, a smaller diameter drill string, etc. As mentioned, the act of pulling a drill string out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drill string 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measuring-while-drilling (MWD) module 256, an optional module 258, a roto-steerable system and motor 260, and the drill bit 226.

The LWD module 254 may be housed in a suitable type of drill collar and can contain one or a plurality of selected types of logging tools. It will also be understood that more than one LWD and/or MWD module can be employed, for example, as represented at by the module 254, 256 of the drillstring assembly 250. Where the position of an LWD module is mentioned, as an example, it may refer to a module at the position of the LWD module 254, the MWD module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform method such as geosteering. As an example, a steerable system can include a PDM or of a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (AND) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field). As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", the term can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
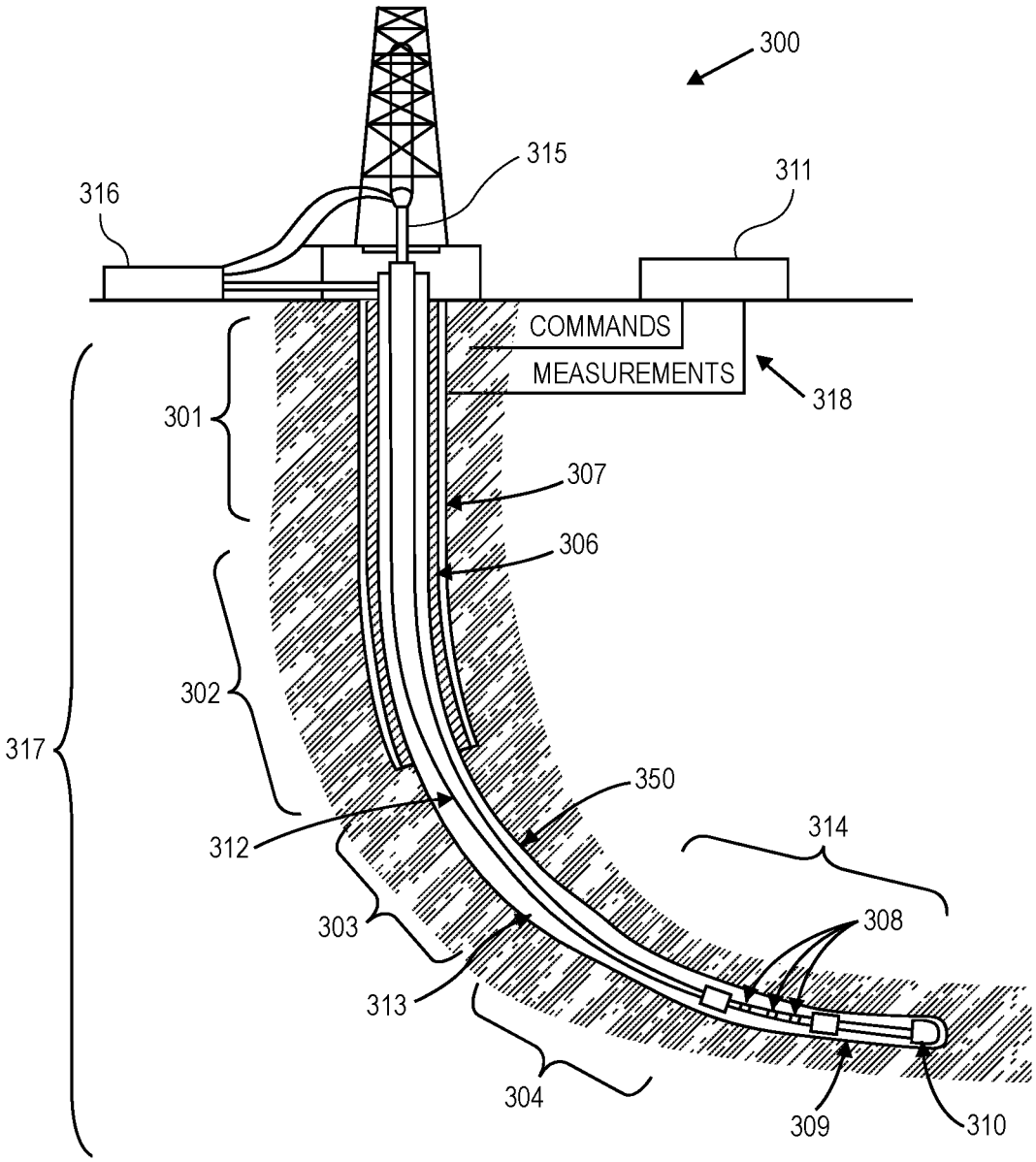
FIG. 3 illustrates a simplified, schematic view of an oilfield and its operation, according to an embodiment.

FIG. 3 shows a schematic diagram depicting an example of a drilling operation of a directional well in multiple sections. The drilling operation depicted in FIG. 3 includes a wellsite drilling system 300 for managing various operations associated with drilling a borehole 350 of a directional well 317. The wellsite drilling system 300 includes various components (e.g., drillstring 312, annulus 313, bottomhole assembly (BHA) 314, kelly (or top drive) 315, mud pit 316, etc.). As shown in the example of FIG. 3, a target reservoir may be located away from (as opposed to directly under) the surface location of the well 317. In such an example, special tools or techniques may be used to ensure that the path along the borehole 350 reaches the particular location of the target reservoir.

As an example, the BHA 314 may include sensors 308, a rotary steerable system 309, and a bit 310 to direct the drilling toward the target guided by a pre-determined survey program for measuring location details in the well. Furthermore, the subterranean formation through which the directional well 317 is drilled may include multiple layers (not shown) with varying compositions, geophysical characteristics, and geological conditions. Both the drilling planning during the well design stage and the actual drilling according to the drilling plan in the drilling stage may be performed in multiple sections (e.g., sections 301, 302, 303 and 304) corresponding to the multiple layers in the subterranean formation. For example, casing 306 may be run into certain sections (e.g., sections 301 and 302) and reinforced with cement that may fill a casing annulus 307 due to the particular formation compositions, geophysical characteristics, and geological conditions.

In the example of FIG. 3, a surface unit 311 may be operatively linked to the wellsite drilling system 300 via communication links 318, which may include, e.g., electromagnetic communication links, wired drill pipe, mud pulse telemetry, etc. The surface unit 311 may be configured to control and monitor the drilling activities by sections in real-time via the communication links 318. In some examples, any suitable hardware component, computing device, or the like, which may reside in surface unit 311, can be configured to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link 318 according to a drilling operation workflow.

During various operations at a wellsite, data can be acquired for analysis and/or monitoring of one or more operations. Such data may include data representing, for example, subterranean formation, equipment, historical and/or other data. Static data can represent, for example, formation structure and geological stratigraphy that define the geological structures of the subterranean formation. Static data may include data about a bore, such as inside diameters, outside diameters, and depths. Dynamic data can relate to, for example, fluids flowing through the geologic structures of the subterranean formation over time. The dynamic data may include, for example, pressures, fluid compositions (e.g. gasoil ratio, water cut, and/or other fluid compositional information), and states of various equipment, and other information.

The static and dynamic data may be used to create and/or update a three dimensional model of one or more subsurface formations. As an example, static and dynamic data from one or more other bores, fields, etc. may be used to create and/or update a three dimensional model. As an example, hardware sensors, core sampling, and well logging techniques may be used to collect data. As an example, static measurements may be gathered using downhole measurements, such as core sampling and well logging techniques. Well logging involves deployment of a downhole tool into the wellbore to collect various downhole measurements, such as density, resistivity, etc., at various depths. Such well logging may be performed using, for example, a drilling tool and/or a wireline tool, or sensors located on downhole production equipment. Once a well is formed and completed, depending on the purpose of the well (e.g., injection and/or production), fluid may flow to the surface (e.g., and/or from the surface) using tubing and other completion equipment. As fluid passes, various dynamic measurements, such as fluid flow rates, pressure, and composition may be monitored. These parameters may be used to determine various characteristics of a subterranean formation, downhole equipment, downhole operations, etc.

To facilitate the processing and analysis of data, simulators may be used to process data. Data fed into the simulator(s) may be historical data, real time data or combinations thereof. Simulation through one or more of the simulators may be repeated or adjusted based on the data received. As an example, oilfield operations can be provided with wellsite and non-wellsite simulators. The wellsite simulators may include a reservoir simulator, a wellbore simulator, and a surface network simulator. The reservoir simulator may solve for hydrocarbon flowrate through the reservoir and into the wellbores. The wellbore simulator and surface network simulator may solve for hydrocarbon flowrate through the wellbore and the surface gathering network of pipelines.

Figure 4:
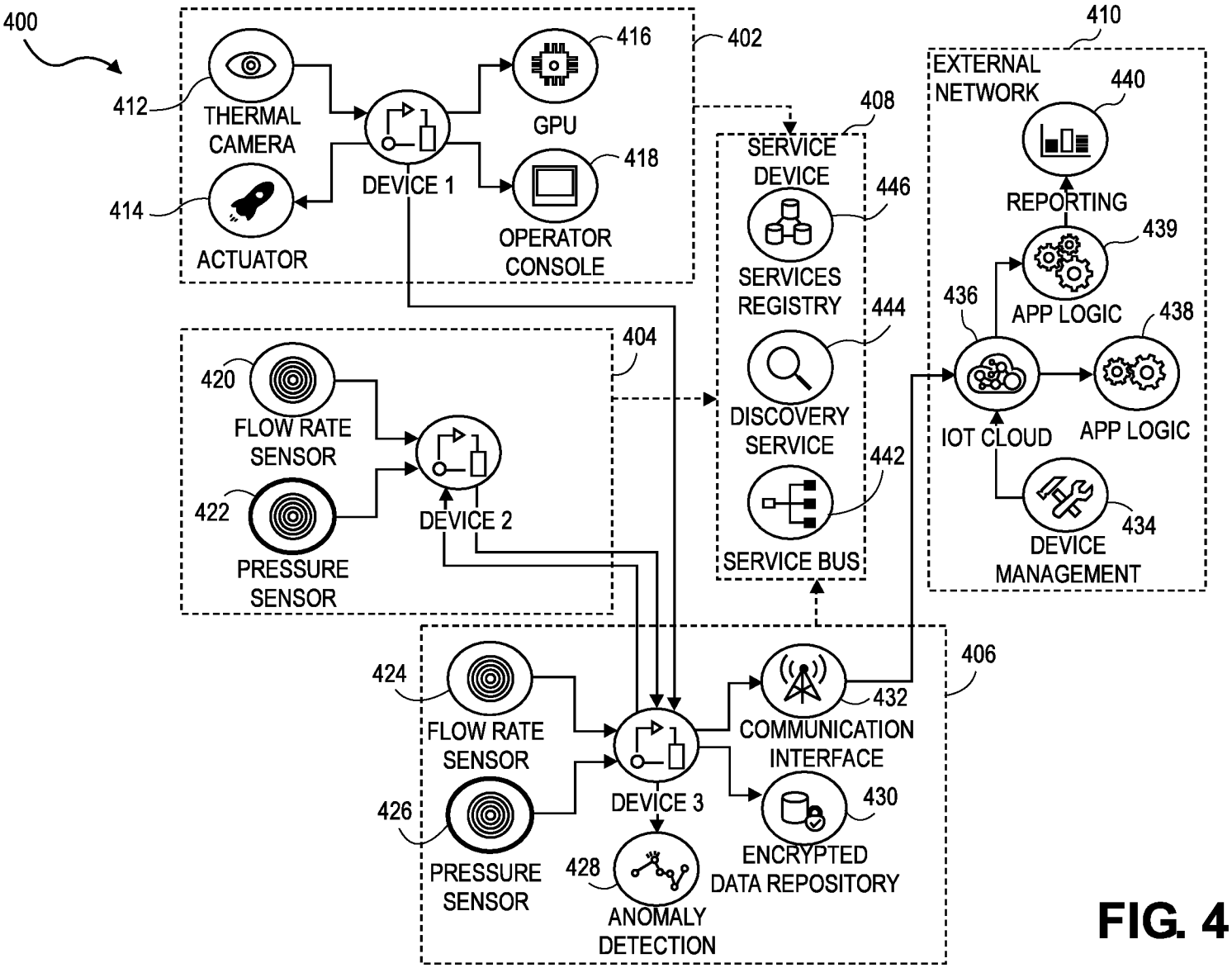
FIG. 4 illustrates a block diagram of an example distributed system for processing data, according to an embodiment.

FIG. 4 is a block diagram of an example distributed system for processing data. The distributed system 400 can include any number of devices 402, 404, and 406. The devices 402, 404, and 406 can be tablet devices, laptop devices, gateway devices, sensors, and the like. The distributed system 400 can also include a service device 408 and an external network 410. In some embodiments, the service device 408 can be any suitable computing device that can transmit data to the devices 402, 404, and 406 and receive data from the devices 402, 404, and 406. The external network 410 can include any set of external computing devices, servers, and the like, that can provide a distributed service or cloud based service. A distributed service can include executing software applications with any number of servers in the external network 410 and returning any number of results based on the execution of the software applications.

In some embodiments, each of the devices 402, 404, and 406 can include various hardware components and software applications that are referred to herein as processing capabilities. For example, device 1 402 can include a thermographic or thermal camera 412, an actuator 414, a graphics processing unit 416, and an operator console 418. The thermal camera 412 can create an image depicting temperature variations of a component of a drilling rig or drillstring, among others, based on infrared radiation. In some examples, the thermal camera 412 can create an image based on temperature variations for any suitable object utilized in resource extraction. The actuator 414 can include a mechanical or electronic mechanism for controlling a component of a drillstring or drilling rig, such as a valve, among others. In some examples, the actuator 414 can be a hydraulic actuator, a pneumatic actuator, an electric actuator, a twisted and coiled polymer actuator, a thermal actuator, a magnetic actuator, or the like. In some embodiments, the actuator 414 includes a control system (not depicted) that can open or close a valve or control additional mechanical components of a drilling rig or drillstring. The graphics processing unit 416 of device 1 402 can be any electronic circuit designed to manipulate and alter memory to enable image creation for input and output devices. In some examples, the graphics processing unit 416 can include any number of arithmetic logic units ("ALUs"), control units, and memory cache. The graphics processing unit 416 can generate images to be displayed by a display device, as well as execute instructions for software applications. For example, graphics processing unit 416 can also execute machine learning techniques based on computations performed in parallel. In some embodiments, the device 1 402 also includes an operator console 418 that can enable the device 1 402 to detect user input, display system administration messages, or the like.

In some embodiments, device 2 404 can include a flow rate sensor 420 and a pressure sensor 422. The flow rate sensor 420 can detect and measure an amount of air or liquid flowing through a pipe of a drilling rig or a drillstring. In some examples, the pressure sensor 422 can detect and measure a pressure associated with gases and liquids flowing through a pipe of a drilling rig or drillstring. For example, the pressure sensor 422 can provide an amount of force that would stop a fluid from expanding based on a force per unit area measurement.

In some embodiments, device 3 406 can include a flow rate sensor 424, a pressure sensor 426, anomaly detection software 428, an encrypted data repository 430, and a communication interface 432. The anomaly detection software 428 can include any suitable artificial intelligence, machine learning technique, or the like, that can determine if detected sensor data values are outside of a predetermined range. For example, the anomaly detection software 428 can indicate that a measurement from a flow rate sensor 424 or a pressure sensor 426 is an anomaly. In some embodiments, the anomalous sensor values can indicate an inaccurate or incorrect sensor value detected by a malfunctioning sensor, or the anomalous sensor values can indicate senor data corresponding to an unexpected event at a drilling rig or within a drillstring. For example, the anomalous sensor values can indicate a pressure that is either higher than a predetermined range or a pressure that is lower than a predetermined range within a component of a drilling rig or drillstring. In some embodiments, the encrypted data repository 430 can store any data related to resource extraction equipment, or any other devices, in an encrypted format. For example, the encrypted data repository 430 can store sensor data values or detected anomalous values, among others. In some embodiments, the communication interface 432 can transmit data to an external network 410 or cloud service. The external network 410 can include device management software 434, an internet of things distributed software service 436, application logic 438 and 439, and a reporting distributed service 440, among others.

In some embodiments, the devices 402, 404, and 406 can transmit data representing processing capabilities to a service device 408. The data representing the processing capabilities can include an identification of the hardware components and/or the software applications accessible by each device 402, 404, or 406. The service device 408 can include a service bus 442, a discovery service 444, and a services registry 446. In some examples, the service bus 442 can detect the processing capabilities of the devices 402, 404, and 406 and store the data representing the processing capabilities in the services registry 446. The services registry 446 can be any suitable data repository such as a database, data structure, or the like, that can store the data representing the processing capabilities for each of the devices 402, 404, and 406. In some embodiments, the discovery service 444 can receive requests from the devices 402, 404, and 406 to execute instructions with various hardware components and software applications accessible by other devices. For example, the discovery service 444 can detect that a device 402, 404, or 406 is attempting to execute an instruction that includes flow rate sensor data. The discovery service 444 can detect the instruction from a first device 402 and transmit the instruction to a second device 404 or a third device 406 that can access a flow rate sensor 420 or 424. In some examples, the discovery service 444 can also return the flow rate sensor data to the first device 402 from the second device 404 or the third device 406. In some embodiments, the discovery service 444 can implement priority protocols to determine which device can execute an instruction. For example, the priority protocols can indicate which device is to execute an instruction based on memory usage within the device, a queue of instructions to execute with the device, or the like. The priority protocols are described in greater detail below in relation to FIG. 5.

It is to be understood that the distributed system 400 of FIG. 4 is provided merely for illustrative purposes. The distributed system 400 can include fewer components or additional components in different embodiments. For example, the distributed system 400 can include two, three, four, five, or any other suitable number of devices. Furthermore, each device 402, 404, or 406 can include a different number and a different combination of hardware components and software applications. In some embodiments, a device 402, 404, or 406 can include machine learning software, an accelerometer, a gyroscope, a global positioning system sensor, a hygrometer, or any other suitable sensor, hardware component, or software application.

Figure 5:
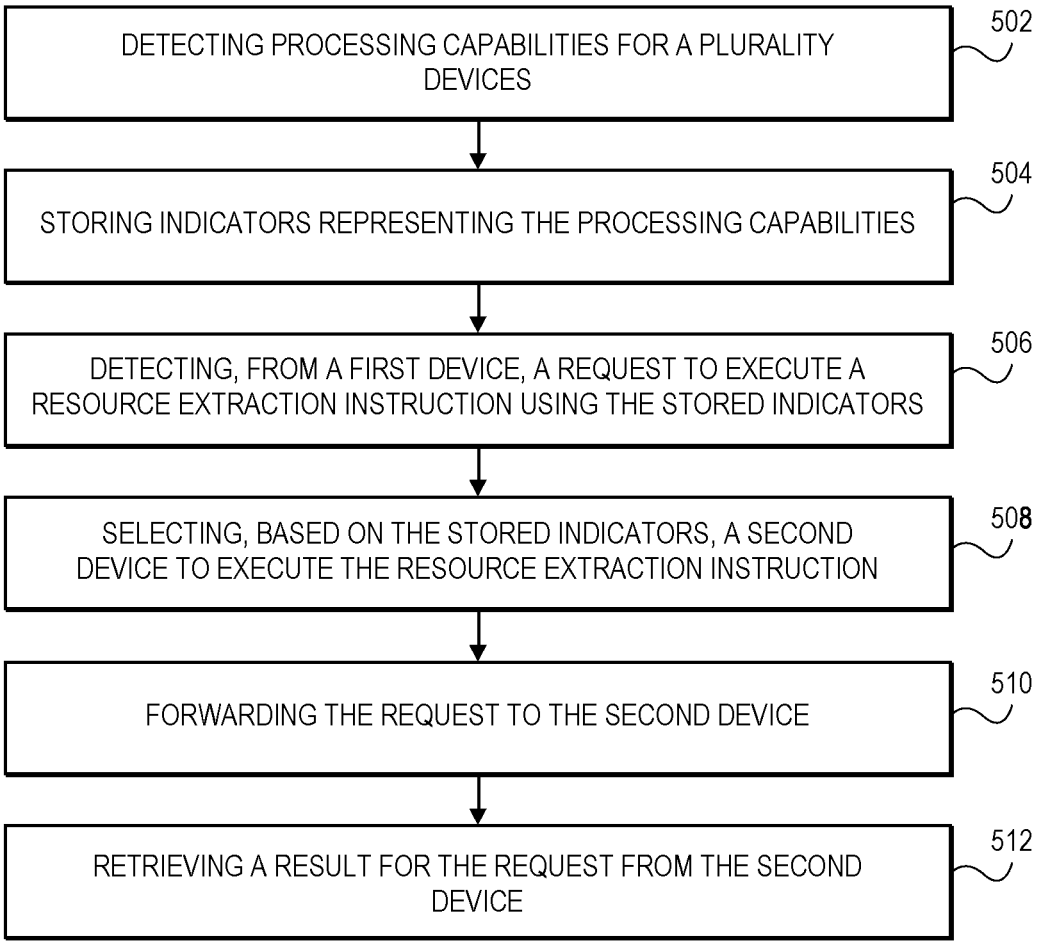
FIG. 5 illustrates a process flow diagram of an example method for distributed data processing, according to an embodiment.

FIG. 5 illustrates a process flow diagram of an example method 500 for processing data, according to an embodiment. In some embodiments, the method 500 can be implemented with a service device or a managing device, among other computer devices. For example, the method 500 can be implemented with the service device 408 of FIG. 4, a device 402, 404, or 406 of FIG. 4 designated as a managing device, or the computing system 701A of FIG. 7.

At block 502, the method 500 can include detecting processing capabilities for any number of devices. In some embodiments, the devices can be any suitable computing devices, such as laptops, tablets, mobile devices, or the like. The devices can be remote devices, in some examples, which are electronically coupled to one another at any suitable distance. For example, the remote devices can be computing devices that transmit data using a wireless interface or a wired interface over any suitable distance. As discussed above, each device can include various hardware components and software applications referred to as processing capabilities. For example, a device can include multiple processors for parallel execution of instructions, a graphics processor or machine learning microcontroller for execution of machine learning techniques, any number of sensors, communication interfaces, and the like. In some embodiments, the processing capabilities can enable the execution of any number of resource extraction instructions described in greater detail below in relation to FIG. 6. For example, the processing capabilities can correspond to resource extraction, seismic testing, drilling rig operations, and the like.

In some embodiments, detecting the processing capabilities of devices in a system is part of a configuration process that occurs prior to devices executing instructions. For example, a service device or a managing device can configure a system by detecting the processing capabilities of each device. In some embodiments, the configuration process can also include storing indicators for (e.g., data representing) each processing capability supported or accessible by each device as described in greater detail below in relation to block 504. In some examples, detecting the processing capabilities of each device can enable the devices to exchange data within a distributed system with a shared server or a managing device. For example, the shared server or the managing device can distribute requests or instructions to be executed by various devices based on the processing capabilities.

At block 504, the method 500 can include storing indicators for the processing capabilities of each device. For example, the method 500 can include generating a data repository, such as a services registry, that stores the processing capabilities of each of the devices. In some examples, data representing the processing capabilities for each of the devices can be stored in a data structure, such as a linked list, a queue, a vector, or the like. In some embodiments, data representing the processing capabilities can be stored in a database, such as a database table that links the processing capabilities available or accessible by each of the devices. In some examples, data representing the processing capabilities can be stored with unique identifiers shared between the devices. For example, the indicators of the processing capabilities can be a binary value or an alphanumerical value, assigned based on the processing capabilities that the devices possess or may access, such as "5" indicating a machine learning technique capability or "15" indicating a camera coupled to a device, among others.

At block 506, the method 500 can include detecting, from a first device, a request to execute a resource extraction instruction based on the stored indicators. The resource extraction instruction can include detecting, analyzing, or aggregating data corresponding to a drilling rig, resource extraction, seismic test, and the like. For example, the request can include resource extraction instructions for detecting, obtaining, or acquiring seismic data from any number of recording devices in a system. The request can indicate hardware capabilities, software capabilities, or any combination thereof, for processing or otherwise analyzing the seismic data. For example, the request can indicate a number of processors to analyze the seismic data within a predetermined period of time, a type of processor to analyze the seismic data, an amount of storage to store the seismic data, and the like. In some embodiments, the request can indicate a set of hardware components or software applications to execute instructions and the request can be distributed for execution by one or more devices. For example, a request can indicate that instructions to be executed by other devices can be performed in parallel, such as collecting images from two or more different cameras coupled to different devices. In some embodiments, a request can indicate that multiple devices are to execute instructions. For example, the request can include detecting sensor data from a number of different pipes, components, or areas of a drilling rig or from different depths along a drillstring. In some embodiments, the request can include detecting a location of a drillstring at different depths in a bore hole and determining a bend in the drillstring or a vibration in the drillstring indicating a whirling motion, such as a forward whirl, a backward whirl, or a chaotic whirl.

At block 508, the method 500 can include selecting, based on the stored indicators, a second device to execute the resource extraction instruction. In some examples, selecting the second device can include determining that the second device is associated with indicators included in the request. For example, the indicators can indicate that the second device can execute instructions in parallel with a graphics processing unit or that the second device can access a pressure sensor, a flow rate sensor, a thermal camera, or any other sensor or component. In some embodiments, the indicators can indicate that the second device can store encrypted data in an encrypted data repository or that the second device can access a distributed service or a cloud service via a communication interface. The distributed service can analyze data and return a result based on any number of services or software applications implemented by the distributed service.

In some embodiments, a request can include detecting objects from multiple cameras. For example, a first camera can detect and track vehicles, a second camera can detect and track people, and a third camera can detect and track oil and gas equipment. In some embodiments, a device can request data from the three cameras, which can include one, two, or three different devices capturing the image data from the three cameras and transmitting the captured image data to the device requesting the image data.

In some embodiments, selecting the second device can include polling the plurality of devices to determine available devices with corresponding processing capabilities and storing identifiers for the available devices. In some examples, one of the available devices is identified as the second device that is to receive the request based on a random selection technique, or any other suitable technique.

At block 510, the method 500 can include forwarding the request to a second device with the processing capability identified in the request. In some embodiments, the request can be forwarded to a second device based on a priority indicator or urgency of executing the request. In some examples, the priority indicator indicates to the second device to execute the request prior to another request previously transmitted to the second device. For example, requests associated with safety equipment, drilling rig components that are identified as having a higher level of importance, and the like, can be executed prior to requests for other devices. In some examples, requests can be forwarded to devices based on a size of a hardware component accessible by the device. For example, a request can be forwarded to a device based on a processing capability of a graphics processing unit, a processor, or the like. In some embodiments, requests for processing low resolution image data below a resolution threshold can be forwarded to devices with smaller graphics processing units, while requests for high resolution image data above the resolution threshold can be forwarded to devices with larger graphics processing units. In some embodiments, each of the requests from predetermined devices can be identified as high priority or the requests can be identified as having any suitable level of priority based on the hardware components or the software applications generating the request. In some examples, a service device can generate a queue corresponding to the devices associated with the processing capability identified in the request. For example, the service device can select the device to execute a request associated with a machine learning software application based on a queue with a first in first out technique, a round robin technique, or a random selection technique, among others.

In some embodiments, forwarding the request can include detecting an identifier for the second device such as a port number, an internet protocol address, or any other suitable identifiers associated with the second device. In some examples, the identifiers for the second device can enable the service device to transmit the request to the second device and detect information from the second device. In some embodiments, the request is forwarded to a second device after detecting a source identifier, a destination identifier, and payload data of the request. The payload data can indicate the processing capabilities associated with the request, and any additional information associated with a device generating the request or the device executing the request.

At block 512, the method 500 can include retrieving a result for the request from the second device. In some embodiments, the result is returned to the first device that generated the request associated with the result. For example, the result can include the data generated by execution of an instruction with requested hardware components and/or software applications of other devices. In some examples, a first device can receive the result from executing the instruction with the second device and the first device can process additional instructions based on the result. For example, the first device can execute subsequent instructions based on sensor data detected from a second device, output generated by a machine learning technique implemented by the second device, or the like.

The process flow diagram of FIG. 5 is not intended to indicate that the operations of the method 500 are to be executed in any particular order, or that all of the operations of the method 500 are to be included in every case. Additionally, the method 500 can include any suitable number of additional operations. For example, the method 500 can include detecting a request and determining a second device that can execute the request with an artificial intelligence software application or processing capability. In some examples, the artificial intelligence application can identify objects from images, identify objects from videos, detect anomalies in data streams, or any combination thereof. In some embodiments, the artificial intelligence application can include a machine learning technique that is implemented by a second device. The machine learning technique can include a neural network, decision tree, vector machine, or the like. In some embodiments, a neural network can employ any suitable convolutional neural network techniques, encoding techniques, or clustering techniques such as k-means clustering, hierarchical clustering, and the like. In some embodiments, a convolutional neural network can include any suitable number of local or global pooling layers that can reduce the dimensions of the data by combining output from neuron clusters at one layer into a single neuron in a subsequent layer.

In some embodiments, the result of executing the machine learning technique instruction can be a multi-dimensional representation of a seismic volume that can be stored on a local computing device or transmitted to an external computing device for storage. In some examples, the result can include a horizontal and/or a vertical boundaries within a seismic volume. The first device can detect the result and execute additional instructions to change a direction of drilling based on the identified horizontal and/or vertical boundaries. For example, the first device can execute a subsequent instruction that changes a state of an actuator, a valve, or any other component of a drilling rig or drill string. In some embodiments, the first device can execute the subsequent instruction locally or transmit the subsequent instruction to the service device for execution by a separate device with access to the actuator, valve, or the like.

Figure 6:
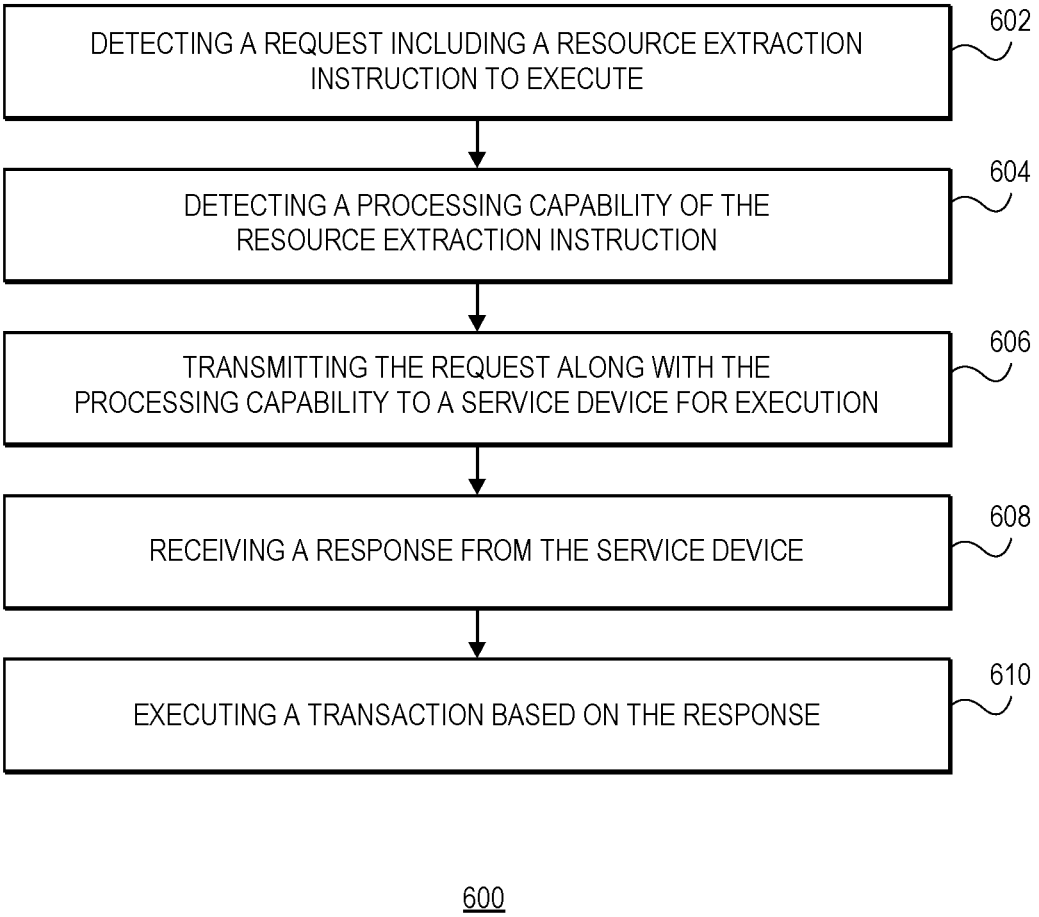
FIG. 6 illustrates a process flow diagram of an example method for distributed data processing, according to an embodiment.

FIG. 6 illustrates a process flow diagram of an example method for processing data with devices, according to embodiments herein. In some embodiments, the method 600 can be implemented with a device, among other computer devices. For example, the method 600 can be implemented with the device 402, 404, or 406 of FIG. 4, or the computing system 701A of FIG. 7.

At block 602, the method 600 includes detecting a request that includes any number of resource extraction instructions to execute for a device. The resource extraction instructions, as referred to herein, are computer-executable instructions that can be executed by a processor, a microcontroller, or any other suitable circuit. In some embodiments, the resource extraction instructions can include any instruction related to retrieving or extracting a resource from a geological reservoir or formation, any instruction related to acquiring or obtaining seismic data representing features of a geological formation, or any instruction related to operating a drilling rig or drillstring, among others. For example, a resource extraction instruction can include detecting a flow rate of mud or other material through a flow pipe, such as flow pipe 228 of FIG. 2. In some embodiments, a resource extraction instruction can include detecting an amount of drilling fluids stored in a mud tank, such as the mud tank 201 of FIG. 2, based on a sensor coupled to the mud tank. In some examples, a resource extraction instruction can also detect or obtain sensor data from a downhole component that monitors a location, vibration, or rotation of a drillstring, such as drillstring 225 of FIG. 2 or drillstring 312 of FIG. 3. In some embodiments, a resource extraction instruction can also include transmitting an instruction to an actuator that opens or closes the bottom hole assembly ("BHA"), such as the BHA 314 of FIG. 3. The resource extraction instructions can also include a request for oilfield data stored in a local device, an external network, such as a cloud network, or the like. The oilfield data can include historical data, actual data, surface data, subsurface data, equipment data, geological data, geophysical data, target data, or anti-target data, among others. In some examples, the oilfield data can be either static data or dynamic data as described in greater detail above in relation to FIG. 3.

In some examples, the resource extraction instructions can be associated with interpreting seismic datasets and can include interpreting or identifying fault structures in geological formations. To interpret the seismic datasets, machine learning software applications may be used to process the seismic datasets. In some embodiments, the machine learning software applications may be stored on a different device, or a different device may have a number of processors, such as graphics processing units, that are designed to execute the machine learning software applications. In some examples, the seismic datasets and the machine learning software applications can be distributed and stored with different devices of a system. For example, a resource extraction instruction for analyzing a seismic dataset can include detecting a source of a seismic dataset to be analyzed, requesting execution of a machine learning software application based on the seismic dataset, and distributing the seismic dataset to a device with the machine learning software application to process or analyze the seismic dataset.

In some embodiments, the resource extraction instruction can be related to additional drilling rig operations. For example, the resource extraction instruction can include a request for telemetry data from a logging-while-drilling (LWD) module, such as the LWD module 254 of FIG. 2 or a measuring-while-drilling (MWD) module, such as the MWD module 256 of FIG. 2. The resource extraction instruction can also include a request for sensor data from sensors 266 of FIG. 2, which monitor mud flow through a standpipe 208 of FIG. 2, among other drilling rig components.

At block 604, the method 600 includes detecting processing capabilities corresponding to the resource extraction instruction. For example, the processing capabilities can indicate the hardware components, software applications, or a combination thereof, that will be used by other devices to execute the resource extraction instruction. In some embodiments, the processing capabilities are static. For example, the static processing capabilities can indicate the hardware components of other devices to execute the resource extraction instruction, such as sensors coupled to a device, a communication interface of a device, a processor speed of a device, a number of graphics processors of a device, and the like. In some examples, the processing capabilities can also indicate dynamic information. The dynamic information can indicate an amount of memory, cache, or the like, that may be used by a device executing the resource extraction instruction.

In some embodiments, the service device maintains dynamic information, such as cache usage, memory usage, or a list of detected universal serial bus devices, among others, for each device. The dynamic information can be detected by the service device periodically, in response to a device connecting to the service device, or in response to a request by the service device to identify the state or operating conditions of one or more devices.

At block 606, the method 600 includes transmitting the request along with the corresponding processing capabilities to a service device for execution. For example, the request can be transmitted with indicators indicating that the request is to be executed with sensor data, a machine learning technique, or any other suitable hardware components or software applications. In some embodiments, a unique identifier can be assigned to each processing capability. For example, the request can include a unique identifier field with an alphanumerical character or binary number that represents one or more processing capabilities corresponding to the request. For example, a unique identifier of "10" can indicate that the request involves executing a set of instructions with one or more graphics processing units, and a unique identifier of "20" can indicate that the request includes detecting sensor data from a remote sensor of another device.

At block 608, the method 600 includes receiving a response from the service device. In some embodiments, the response can include data generated by executing the resource extraction instruction. For example, the response can include sensor data obtained by a sensor, a set of data values returned by a machine learning technique, or the like. In some embodiments, the response can indicate if objects are detected within an image, if a vibration is detected by a sensor, if a flow rate of a pipe is within a predetermined range, or the like. In some embodiments, the response can be received synchronously or asynchronously. For example, the response can be received within a predetermined period of time following the request being transmitted to a service device or the response can be received after the predetermined period of time following a request being transmitted to the service device.

At block 610, the method 600 includes executing a transaction based on the response. For example, the method 600 can include detecting the response and executing a transaction or subsequent instruction that includes the result. In some embodiments, the transaction can include an operation based on sensor data obtained from a separate device, or the like. For example, the transaction can include changing the state of an actuator from open to closed or closed to open based on detected sensor data, transmitting an alert to an external device based on an object detected in an image from a camera, closing a blowout preventer in response to sensor data, such as a flow rate of fluid, and the like. In some embodiments, the transaction can include transmitting alerts to devices coupled to personnel proximate the drilling rig. The alerts can indicate flow rates within pipes of the drilling rig or drillstring, temperatures within components of the drilling rig, or vibrations detected proximate components of the drilling rig, or any anomalies detected from a data stream, among others. In some embodiments, the second device identifies an event, such as a change in the flow rates within pipes of the drilling rig or drillstring, from the sensor data, and the response to the request includes a command to change a state of an actuator based on the event. For example, the command can indicate to open or close a valve with an actuator or rotate a valve by any specified amount, such as 90 degrees, 180 degrees, and the like.

The process flow diagram of FIG. 6 is not intended to indicate that the operations of the method 600 are to be executed in any particular order, or that all of the operations of the method 600 are to be included in every case. Additionally, the method 600 can include any suitable number of additional operations.

In one or more embodiments, the functions described can be implemented in hardware, software, firmware, or any combination thereof. For a software implementation, the techniques described herein can be implemented with modules (e.g., procedures, functions, subprograms, programs, routines, subroutines, modules, software packages, classes, and so on) that perform the functions described herein. A module can be coupled to another module or a hardware circuit by passing and/or receiving information, data, arguments, parameters, or memory contents. Information, arguments, parameters, data, or the like can be passed, forwarded, or transmitted using any suitable means including memory sharing, message passing, token passing, network transmission, and the like. The software codes can be stored in memory units and executed by processors. The memory unit can be implemented within the processor or external to the processor, in which case it can be communicatively coupled to the processor via various means as is known in the art.

Figure 7:
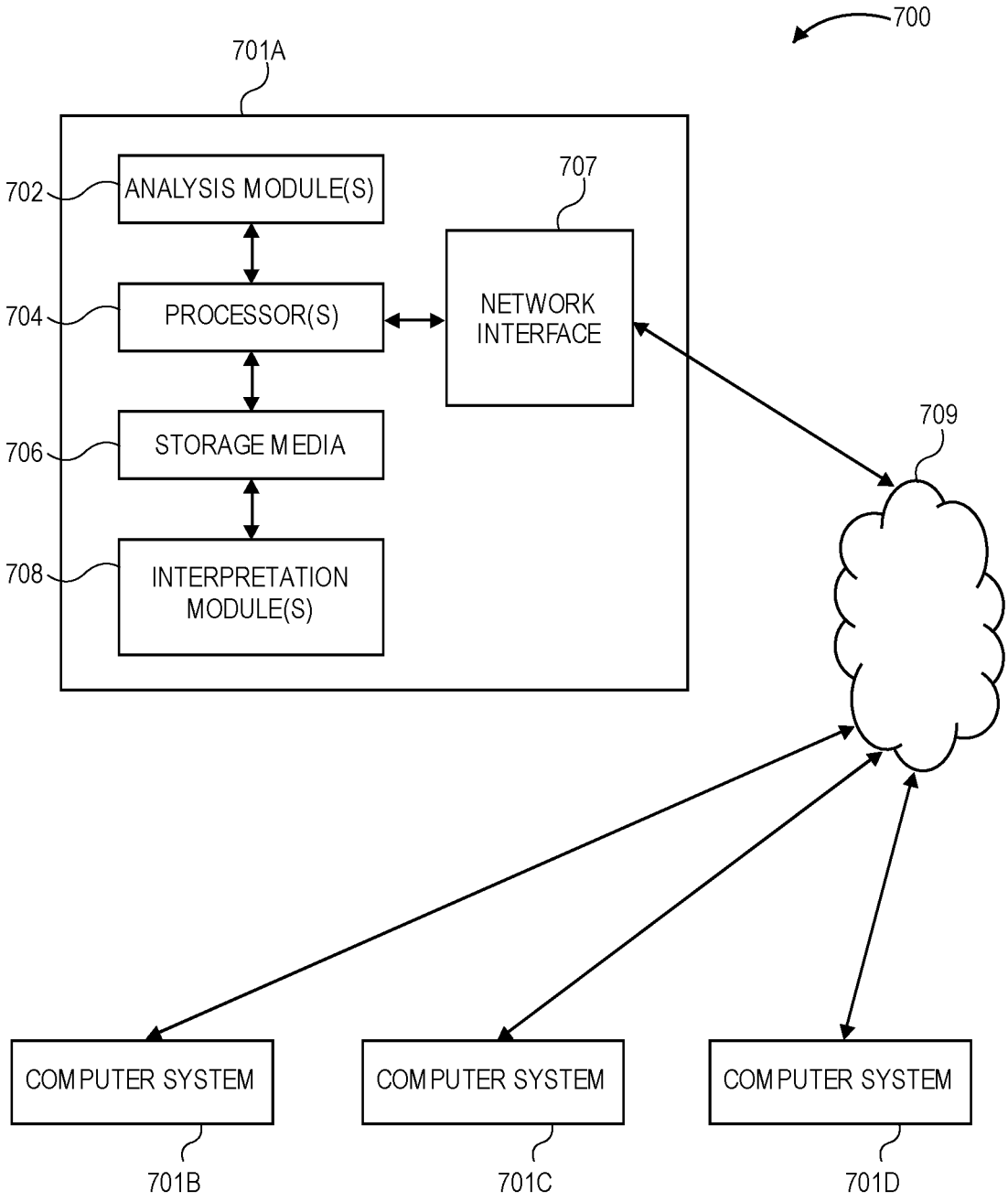
FIG. 7 illustrates a schematic view of a computing system, according to an embodiment.

In some embodiments, any of the methods of the present disclosure may be executed by a computing system. FIG. 7 illustrates an example of such a computing system 700, in accordance with some embodiments. The computing system 700 may include a computer or computer system 701A, which may be an individual computer system 701A or an arrangement of distributed computer systems. The computer system 701A includes one or more analysis module(s) 702 configured to perform various tasks according to some embodiments, such as one or more methods disclosed herein. To perform these various tasks, the analysis module 702 executes independently, or in coordination with, one or more processors 704, which is (or are) connected to one or more storage media 706. The processor(s) 704 is (or are) also connected to a network interface 707 to allow the computer system 701A to communicate over a data network 709 with one or more additional computer systems and/or computing systems, such as 701B, 701C, and/or 701D (note that computer systems 701B, 701C and/or 701D may or may not share the same architecture as computer system 701A, and may be located in different physical locations, e.g., computer systems 701A and 701B may be located in a processing facility, while in communication with one or more computer systems such as 701C and/or 701D that are located in one or more data centers, and/or located in varying countries on different continents).

A processor can include a microprocessor, microcontroller, processor module or subsystem, programmable integrated circuit, programmable gate array, or another control or computing device.

The storage media 706 can be implemented as one or more non-transitory computer-readable or non-transitory machine-readable storage media. Note that while in the example embodiment of FIG. 7 storage media 706 is depicted as within computer system 701A, in some embodiments, storage media 706 may be distributed within and/or across multiple internal and/or external enclosures of computing system 701A and/or additional computing systems. Storage media 706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 700 contains one or more interpretation module(s) 708. In the example of computing system 700, computer system 701A includes the interpretation module 708. In some embodiments, a single interpretation module 708 may be used to perform some or all aspects of one or more embodiments of the methods. In alternate embodiments, a plurality of interpretation modules 708 may be used to perform some or all aspects of techniques described herein.

It should be appreciated that computing system 700 is only one example of a computing system, and that computing system 700 may have more or fewer components than shown, may combine additional components not depicted in the example embodiment of FIG. 7, and/or computing system 700 may have a different configuration or arrangement of the components depicted in FIG. 7. The various components shown in FIG. 7 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A system for oilfield processing data comprising:
one or more storage devices; and
a processor to execute instructions stored in the one or more storage devices, the instructions to cause the processor to perform operations comprising:
detecting a processing capability of respective devices of a plurality of devices;
storing indicators each of which represents the processing capability of the respective devices of the plurality of devices;
detecting, from a first device of the plurality of devices, a request to execute a resource extraction instruction using the stored indicators, wherein the request includes a required processing capability of a device of the plurality of devices to execute the resource extraction instruction, and wherein the request indicates a number of processors to analyze a seismic data within a predetermined period of time, a type of processor to analyze the seismic data, and an amount of storage to store the seismic data;
polling the plurality of devices;
determining, from the polling, available devices of the plurality of devices having the required processing capability identified in the request;
selecting, based on the stored indicators, a second device from the plurality of devices that is one of the available devices to execute the resource extraction instruction;
forwarding the request to the second device of the plurality of devices; and
retrieving a result for the request from the second device, wherein the result is returned to the first device.

2. The system of claim 1, wherein the processing capability comprises a graphics processing unit, a flow rate sensor, a pressure sensor, an encrypted data repository, a network interface card, an actuator, a thermal camera, a depth camera, or a combination thereof.

3. The system of claim 1, wherein the processing capability comprises an artificial intelligence application that identifies at least one first object from an image, identifies at least one second object from a video, detects at least one anomaly in a data stream, or a combination thereof.

4. The system of claim 1, wherein the operations further comprise:

storing identifiers for the available devices.

5. The system of claim 1, wherein the processing capability comprises at least one of a sensor coupled to a drilling rig or a software application that analyzes sensor data from the sensor.

6. The system of claim 1, wherein processing the request comprises detecting at least one of a source identifier, a destination identifier, or payload data, wherein the payload data represents the required processing capability of the request.

7. The system of claim 1, wherein the operations further comprise generating a queue for one or more of the devices associated with the required processing capability identified in the request.

8. The system of claim 1, wherein the operations further comprise generating a priority indicator for the request, wherein the priority indicator is based on memory usage within the second device, a queue of instructions to execute with the second device, or a combination thereof.

9. The system of claim 8, wherein the operations further comprise determining, using the priority indicator, that the request is to be executed with the second device prior to a second request previously received by the second device.

10. The system of claim 1, wherein the resource extraction instruction comprises detecting sensor data from a sensor coupled to a drilling rig, wherein the second device identifies an event from the sensor data, and wherein a response to the request comprises a command that uses the event to determine a state of an actuator.

11. The system of claim 1, wherein the resource extraction instruction comprises detecting a flow rate of a mud material through a flow pipe of a drilling rig.

12. A system for oilfield processing data comprising:

one or more storage devices; and a processor to execute instructions stored in the one or more storage devices, the instructions to cause the processor to perform operations comprising:

detecting a request comprising a resource extraction instruction to execute, wherein the request indicates a number of processors to analyze a seismic data within a predetermined period of time, a type of processor to analyze the seismic data, and an amount of storage to store the seismic data;

detecting a required processing capability of the resource extraction instruction;

determining, from polling a plurality of devices, available devices of the plurality of devices having the required processing capability;

selecting a service device from the plurality of devices that is one of the available devices;

transmitting the request along with data representing the required processing capability to the service device for execution;

receiving a response from the service device, the response comprising data generated by executing the resource extraction instruction; and executing a transaction based on the response.

13. The system of claim 12, wherein the required processing capability comprises a graphics processing unit, a flow rate sensor, a pressure sensor, an encrypted data repository, a network interface card, an actuator, a thermal camera, a depth camera, or a combination thereof.

14. The system of claim 12, wherein the required processing capability comprises an artificial intelligence application that identifies one or more first objects from an image, identifies one or more second objects from a video, detects one or more anomalies from a data stream, or a combination thereof.

15. The system of claim 14, wherein the transaction comprises transmitting an alert to an external device based on the one or more anomalies.

16. The system of claim 12, wherein the required processing capability further comprises dynamic information, wherein the dynamic information represents an amount of memory or an amount of cache to execute the resource extraction instruction.

17. The system of claim 12, wherein the transaction comprises transmitting an alert representing a flow rate of a component of a drilling rig to an external device.

18. A method for oilfield processing data comprising:

detecting a processing capability of respective devices of a plurality of devices;

storing indicators each of which represents the processing capability of the respective devices of the plurality of devices;

detecting, from a first device of the plurality of devices, a request to execute a resource extraction instruction using the stored indicators, wherein the request includes a required processing capability of a device of the plurality of devices to execute the resource extraction instruction, and wherein the request indicates a number of processors to analyze a seismic data within a predetermined period of time, a type of processor to analyze the seismic data, and an amount of storage to store the seismic data;

polling the plurality of devices;

determining, from the polling, available devices of the plurality of devices having the required processing capability identified in the request;

selecting, based on the stored indicators, a second device from the plurality of devices that is one of the available devices to execute the resource extraction instruction;

forwarding the request to the second device of the plurality of devices; and retrieving a result for the request from the second device, wherein the result is returned to the first device.

19. The method of claim 18, further comprising:

storing identifiers for the available devices.

20. The method of claim 18, wherein the processing capability comprises a graphics processing unit, a flow rate sensor, a pressure sensor, an encrypted data repository, a network interface card, an actuator, a thermal camera, a depth camera, or a combination thereof.

* * * * *